US007134548B2

(12) United States Patent
Meehan et al.

(10) Patent No.: US 7,134,548 B2
(45) Date of Patent: Nov. 14, 2006

(54) CONVERTIBLE WEIGHT DEVICE CASE

(75) Inventors: Charles Meehan, Orange, VA (US); Francisco D. Adler, Red Lion, PA (US); Hua Jiping, Hefei Andy Fitness Product Ltd., Floor 9, Wencai Plaza, No. 28, Yiming Road, Hefei (CN) 230061

(73) Assignee: Hua Jiping, Hefei (CN)

( * ) Notice: Subject to any disclaimer, the term of this patent is extended or adjusted under 35 U.S.C. 154(b) by 0 days.

(21) Appl. No.: 10/756,750

(22) Filed: Jan. 14, 2004

(65) Prior Publication Data

US 2005/0051445 A1 Mar. 10, 2005

Related U.S. Application Data

(60) Provisional application No. 60/439,795, filed on Jan. 14, 2003.

(51) Int. Cl.
*B65D 85/20* (2006.01)
*B65D 5/52* (2006.01)

(52) U.S. Cl. ..... 206/315.1; 206/45.2

(58) Field of Classification Search ..... 206/579, 206/372, 315.1, 745, 747, 736, 486, 373, 206/45.2, 45.23; 190/18 A, 16, 115; 482/910, 482/104, 106, 108; 211/2, 85.7; 220/212.5, 220/846, 843, 844, 840, 841; D21/681, 684; D3/259

See application file for complete search history.

(56) References Cited

U.S. PATENT DOCUMENTS 455,770 A * 7/1891 Smith ..... 206/749
754,227 A * 3/1904 Moog ..... 211/2
838,031 A * 12/1906 Kirkpatrick ..... 206/45.23
1,088,746 A * 2/1914 Babbitt ..... 190/16
2,707,538 A * 5/1955 Mayer, Sr. et al. ..... 190/16
4,477,074 A * 10/1984 Bushnell ..... 482/108
4,666,038 A * 5/1987 Minneman ..... 206/315.2
4,930,628 A * 6/1990 Bridges ..... 206/45.23
5,575,742 A * 11/1996 Wu ..... 482/92
5,630,776 A * 5/1997 Yang ..... 482/104
5,697,870 A * 12/1997 Osborn ..... 482/52
5,979,620 A * 11/1999 Lurie et al. ..... 190/16
5,997,442 A * 12/1999 Cordes ..... 482/52

OTHER PUBLICATIONS

Cap Barbell [Online], Model RK-12 Dumbbell Rack [Internet Archive Date Mar. 3, 2001], [Retrieved on Mar. 18, 2005] Retrieved from Internet <URL:http://www.capbarbell.com/products_template_commodity.htm>.*

* cited by examiner

*Primary Examiner*—Mickey Yu
*Assistant Examiner*—J. Gregory Pickett
(74) *Attorney, Agent, or Firm*—Stites & Harbison PLLC; Douglas E. Jackson

(57) ABSTRACT

A convertible weight device case and a method of using same, the convertible weight device case including a first shell having a plurality of compartments sized to receive weight devices therein, a second shell, and at least one hinge pivotably connecting the first shell to the second shell to allow the first shell and the second shell to be rotated about the hinge relative to each other between a closed configuration and a rack configuration. In the closed configuration, the first shell and the second shell are interfaced together so that the second shell impedes access to the weight devices received in the plurality of compartments of the first shell. In the rack configuration, the first shell and the second shell are angled upright with the hinge elevated above a floor level so that access to the plurality of compartments of the first shell is provided.

36 Claims, 6 Drawing Sheets

CONVERTIBLE WEIGHT DEVICE CASE

This application claims priority to U.S. Provisional Application No. 60/439,795, filed Jan. 14, 2003, the contents of which are incorporated herein by reference.

BACKGROUND OF THE INVENTION

1. Field of the Invention

The present invention is directed to cases for weight resistance devices such as dumbbells and weight plates which may be used to protect, store and/or transport these devices. In particular, the present invention is directed to such cases which may also be converted for use as an A-frame rack to display and provide access to the weight resistance device.

2. Description of Related Art

Weight resistance devices (referred to hereinafter as "weight devices") such as dumbbells and weight plates are commonly used for various exercises and resistance training. A user typically utilizes a pair of matched dumbbells having the same weight. Similarly, weight plates are used together with a barbell, a pair of matched weight plates having the same weight being secured to opposing ends of the barbell. Weight plates may also be used as dumbbells, such weight plates typically being smaller and used in conjunction with separate handles for securing the weight plates. These weight devices are used in exercise facilities such as gyms, as well as in homes. In this regard, A-frame racks are often provided in exercise facilities that store and display plurality the weight devices so that users can easily access and use them. For instance, dumbbells are often displayed in A-frame racks in matched pairs while weight plates are often displayed A-frame racks that have plurality of elongated bars through which weight plates are supported.

Weight devices are typically sold or distributed through sporting goods stores or the like. While many weight devices are sold individually, many weight devices are sold as matched sets having pairs thereof in various weight increments. Dumbbell sets are generally sold in boxes or cases, for example, in plastic cases with handles which allow storage of the dumbbells and facilitate sale and transport thereof.

U.S. Pat. No. 5,630,776 to Yang discloses a novel folding dumbbell rest in which two cylinders are rotatably attached to a V-shaped plate. The reference discloses that the two cylinders are provided with notches adapted to retain handles of a plurality of dumbbells so that the dumbbells may be stored. The reference also discloses that upon rotation of the cylinders, the dumbbell rest is configurable into an A-shaped configuration for allowing display and access to the dumbbells. Thus, the folding dumbbell rest described in Yang allows for storage and transport of dumbbells as well as providing a user easy access to the dumbbells so that the dumbbells may be utilized. However, the two cylinders of the folding dumbbell rest are relatively narrow, spanning only the width of the handles of the dumbbells. This results in the fact that when the dumbbell rest is in the A-shaped configuration, it is not vertically stable and can easily tip over. Consequently, the folding dumbbell rest as described in Yang is not stable enough to allow effective use as a rack.

Therefore, in view of the above, there still exists an unfulfilled need for a device that allows weight devices such as dumbbells and weight plates to be stored and transported easily. In addition, there still exists an unfulfilled need for a device that displays such weight devices so that they can be easily accessed and used.

SUMMARY OF THE INVENTION

In view of the above, one aspect of the present invention is a convertible weight device case that allows weight devices to be stored and transported easily.

Another aspect of the present invention is a convertible weight device case that allows display of the weight devices so that they can be easily accessed and used.

In accordance with yet another aspect of the present invention, a method is provided for displaying a plurality of weight devices stored in a convertible weight device case.

In view of the above, one aspect of the present invention is a convertible weight device case comprising a first shell having a plurality of compartments sized to receive weight devices therein, a second shell, and at least one hinge pivotably connecting the first shell to the second shell to allow the first shell and the second shell to be rotated about the hinge relative to each other between a closed configuration and a rack configuration, wherein in the closed configuration, the first shell and the second shell are interfaced together so that the second shell impedes access to the weight devices received in the plurality of compartments of the first shell, and wherein in the rack configuration, the first shell and the second shell are angled upright with the hinge elevated above a floor level so that-access to the plurality of compartments of the first shell is provided.

In accordance with one embodiment, the first shell and/or the second shell is rotated more than 180 degrees about the hinge relative to other shell, for example, approximately 300 degrees, so that the first shell and the second shell are angled upright at approximately 60 degrees relative to each other. In accordance with another example embodiment, the convertible weight device case further includes a position locking mechanism for maintaining the convertible weight device case in the rack configuration. In this regard, the position locking mechanism may be implemented as a rigid brace, a strap, or a cord. In addition, the first shell and/or the second shell may include a brace engagement mechanism that is adapted to engage the position locking mechanism. Furthermore, a plurality of clasps may be provided for securing the first shell and the second shell together when the convertible case is in the closed configuration.

In accordance with another embodiment of the present invention, the plurality of compartments provided in the first shell are a plurality of different sizes for receiving weight devices of different sizes. In this regard, the smallest of the plurality of compartments are positioned proximate to the hinge with the size of the compartments increasing away from the hinge. In accordance with still another embodiment, the convertible weight device case further includes a handle. The handle may be positioned on the first shell proximate to the hinge, or be made integral with the hinge. In yet another embodiment of the present invention, the convertible weight device case further includes at least two wheels to allow the convertible weight device case to be rolled. In this regard, the wheels are preferably positioned at an opposite end of the convertible weight device case from the handle.

In accordance with yet another embodiment of the present invention, the second shell of the convertible weight device case further includes a plurality of compartments sized to receive weight devices therein. In this regard, the weight devices may be dumbbells and the convertible weight device case be adapted to store plurality of pairs of dumbbells, one dumbbell of each pair being received in a compartment of the first shell, and the other dumbbell of each pair being received in a compartment of the second shell that corresponds to the compartment of the first shell. In one such implementation, the plurality of compartments of the second shell are positioned so that when the convertible weight device case is in the rack configuration, one dumbbell of each of the plurality of pairs of dumbbells that is received in a compartment of the first shell is elevated substantially similar distance above a floor surface as the other dumbbell of each of the plurality of pairs of dumbbells that is received in a corresponding compartment of the second shell. In another implementation, the plurality of compartments of the second shell are positioned offset to the plurality of compartments of the first shell.

In accordance with another aspect of the present invention, a convertible weight device case is provided which is convertible between a closed configuration and a rack configuration, the convertible weight device case comprising a first shell having a plurality of compartments sized to receive weight devices therein, a second shell, at least one hinge pivotably connecting the first shell to the second shell to allow the first shell and the second shell to be rotated more than 180 degrees about the hinge relative to each other, at least one clasp for securing the first shell and the second shell together when the convertible case is in the closed configuration wherein the first shell and the second shell are interfaced together so that the second shell impedes access to the weight devices received in the plurality of compartments of the first shell, and a position locking mechanism for maintaining the convertible weight device case in the rack configuration wherein the first shell and the second shell are angled upright with the hinge elevated above a floor level so that access to the plurality of compartments of the first shell is provided.

In accordance with another embodiment of the present invention, the convertible weight device case may further include a handle positioned proximate to the hinge. In addition, the second shell of the convertible weight device case may further include a plurality of compartments sized to receive weight devices therein. In this regard, the weight devices may be dumbbells, and the convertible weight device case may be adapted to store plurality of pairs of dumbbells, one dumbbell of each pair being received in a compartment of the first shell, and the other dumbbell of each pair being received in a compartment of the second shell that corresponds to the compartment of the first shell. In one implementation, the plurality of compartments of the second shell are positioned so that when the convertible weight device case is in the rack configuration, one dumbbell of each pair of dumbbells that is received in a compartment of the first shell is elevated substantially similar distance above a floor surface as the other dumbbell of each pair of dumbbells that is received in a corresponding compartment of the second shell. The convertible weight device case may further include at least two wheels to allow the convertible weight device case to be rolled.

In accordance with another aspect of the present invention, a method of displaying a plurality of weight devices stored in a convertible weight device case is provided, the method comprising the steps of providing a convertible weight device case which includes a first shell having a plurality of compartments sized to receive weight devices therein, a second shell, and at least one hinge pivotably connecting the first shell to the second shell, rotating of the first shell and/or the second shell more than 180 degrees about the hinge relative to the other, and angling upright the first shell and the second shell so that the hinge is elevated above a floor level and access to the plurality of compartments of the first shell is provided.

In accordance with another embodiment, the method may further include the step of locking the convertible weight device case in the rack configuration. The step of locking may be attained using a position locking mechanism. In addition, the convertible weight device case may further include a plurality of clasps, the method further including the step of using the plurality of clasps to secure the first shell and the second shell together when the convertible case is in the closed configuration. Further, the convertible weight device case may also include a handle, the method further including the step of lifting the handle to angle upright the first shell and the second shell. In accordance with yet another embodiment of the present invention, the second shell of the convertible weight device case further includes a plurality of compartments sized to receive weight devices therein. The convertible weight device case may also include at least two wheels to allow the convertible weight device case to be rolled.

In accordance with still another aspect of the present invention, a convertible weight device case is provided which is convertible between a closed configuration and a rack configuration, the convertible weight device case comprising a first shell having a plurality of compartments sized to receive weight devices therein, a second shell, at least one clasp for securing the first shell and the second shell together when the convertible case is in the closed configuration wherein the first shell and the second shell are interfaced together so that the second shell impedes access to the weight devices received in the plurality of compartments of the first shell, and a position locking mechanism for maintaining the convertible weight device case in the rack configuration wherein the first shell and the second shell are angled upright so that access to the plurality of compartments of the first shell is provided.

In accordance with another embodiment, the second shell of the convertible weight device case further includes a plurality of compartments sized to receive weight devices therein. In yet another embodiment, the convertible weight device case includes at least one hinge pivotably connecting the first shell to the second shell to allow the first shell and the second shell to be rotated about the hinge relative to each other. In still another embodiment, the convertible weight device case further includes a handle and/or at least two wheels to allow the convertible weight device case to be rolled.

These and other aspects of the present invention will become more apparent from the following detailed description of the preferred embodiments of the present invention when viewed in conjunction with the accompanying drawings.

DETAILED DESCRIPTION OF THE PREFERRED EMBODIMENT

The present invention is directed to a convertible weight device case that can be advantageously used to store, protect, and transport plurality of weight resistance devices (referred to hereinafter as "weight devices"). These weight devices may include dumbbells and/or weight plates that are used in conjunction with barbells, weight adjustable dumbbells in which weight plates are secured to a shortened barbells, or other weight devices. In addition, in accordance with the preferred embodiment, the convertible weight device case is further adapted to be converted to an A-frame rack configuration that allows display of the weight devices stored within the convertible weight device case in a user friendly manner so that they may be readily accessed and used.

Figure 1:
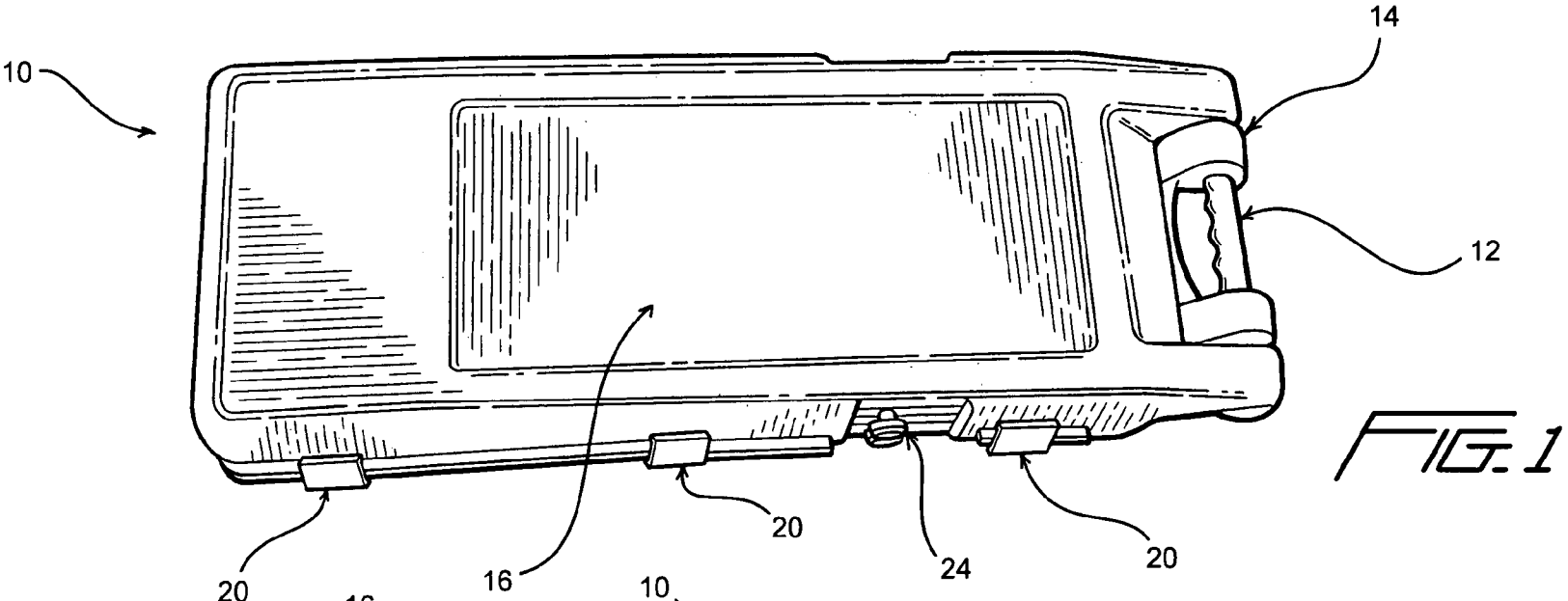
FIG. 1 is a top perspective view of a convertible weight device case in accordance with one embodiment of the present invention.

In this regard, FIG. 1 shows a convertible weight device case 10 in accordance with one embodiment of the present invention which is applied specifically to dumbbells, the details of which is described herein below. However, the present invention is not limited to such application, and it should be understood that the present invention is also applicable to other weight devices such as weight plates as noted, whether such weigh plates are used in conjunction with barbells or with weight adjustable dumbbells.

As shown in FIG. 1, the convertible weight device case 10 has an elongated shape in the illustrated embodiment with compartments sized to allow a plurality of weight devices to be stored therein as described in detail hereinbelow. The convertible weight device case 10 preferably includes a handle 12 which may be grasped by the user to transport the convertible weight device case 10. In addition, the convertible weight device case 10 is provided with a hinge 14 that allows the convertible weight device case 10 to be opened and used in the manner also described below.

Figure 2:
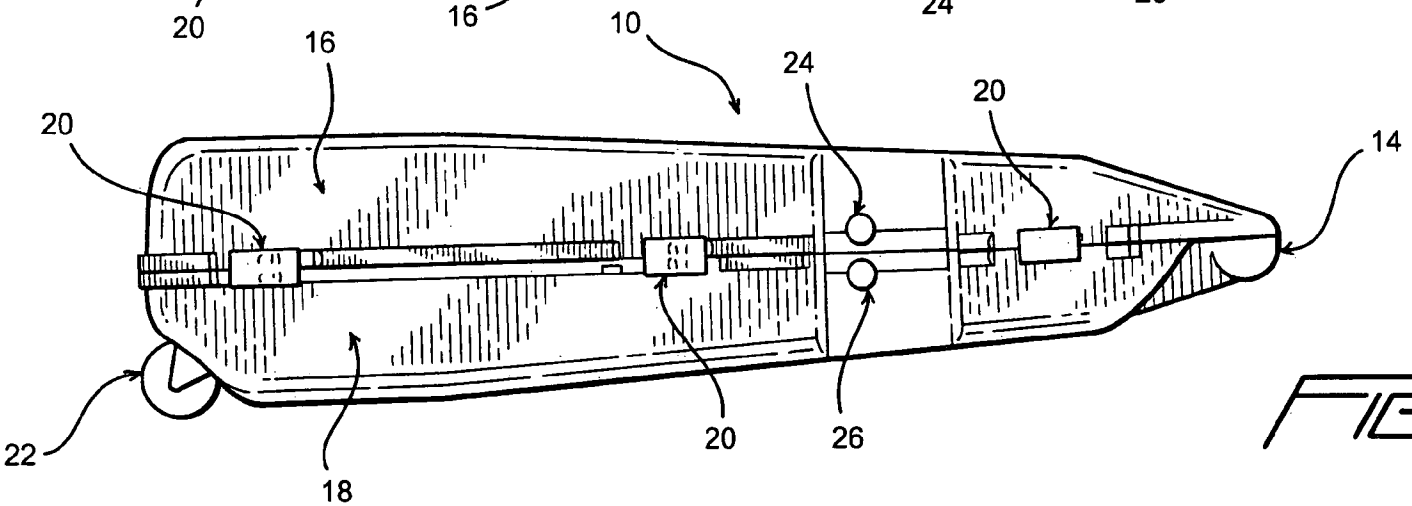
FIG. 2 is a side profile view of the convertible weight device case shown in FIG. 1.

FIG. 2 shows a side profile view of the convertible weight device case 10 so that the various features thereof can be better described and appreciated. In particular, as shown in FIG. 2, the convertible weight device case 10 comprises two shells, a first shell 16 and a second shell 18 that are sized substantially similarly in the present embodiment so that they can be interfaced together in a closed configuration as shown in FIG. 2 in a clam shell manner so as to enclose the weight devices stored in the convertible weight device case 10 and impede access thereto. In this regard, the convertible weight device case 10 as shown in FIG. 2 includes a plurality of clasps 20 which secure the first shell 16 and the second shell 18 together when the convertible weight device case 10 is in the closed configuration.

In the embodiment shown in FIGS. 1 and 2, the first shell 16 is hinged to the second shell 18 by hinge 14 which allows the first shell 16 and the second shell 18 to be pivoted away from one another as the convertible weight device case 10 is opened and/or converted to an A-frame rack as described below. In addition, the convertible weight device case 10 in accordance with the illustrated embodiment is also provided with wheels 22 that facilitates transporting of the convertible weight device case 10, even when plurality of weight devices are stored therein. Such a feature is desirable since a plurality of weight devices will have substantial weight and would require significant effort by the user to transport the convertible weight device case 10 without the aid of the wheels 22. Hence, the user can grasp the handle 12 of the convertible weight device case 10, pivot the convertible weight device case 10 about wheels 22 so that it is supported thereon, and pull or push the convertible weight device case 10 in the direction desired thereby transporting the plurality of weight devices stored therein. Furthermore, the convertible weight device case 10 is provided with brace engagement mechanisms 24 and 26 that are provided on the first shell 16 and second shell 18 respectively which can be used to maintain the convertible weight device case 10 in an upright and open configuration to provide an A-frame rack as discussed in further detail hereinbelow.

Figure 3:
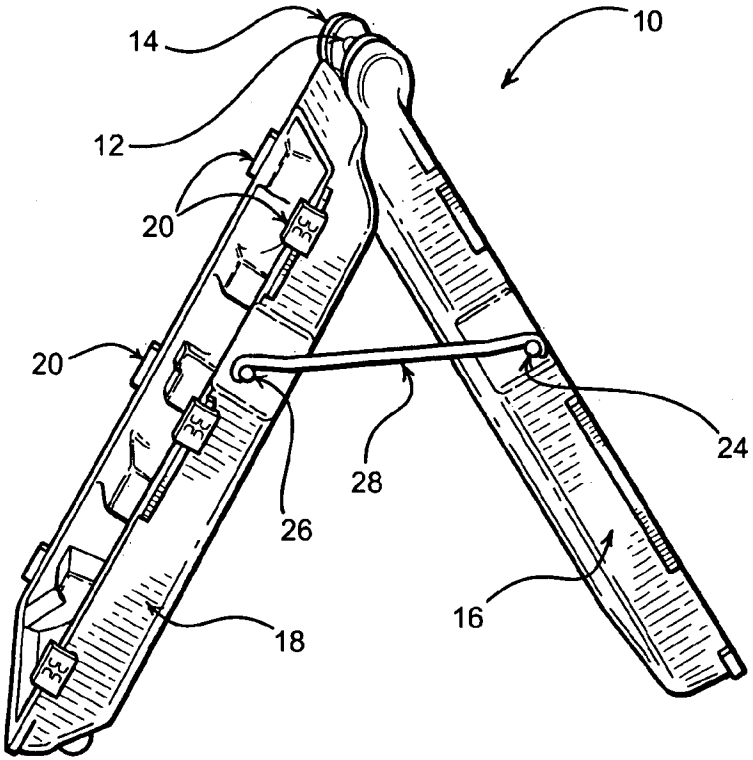
FIG. 3 is a side perspective view of the convertible weight device case of FIG. 1 in an open rack configuration.

FIG. 3 shows the convertible weight device case 10 of FIGS. 1 and 2 in an upright and open configuration so as to convert the convertible weight device case 10 into an A-frame rack. In this regard, the first shell 16 and the second shell 18 are pivoted about hinge 14 beyond 180 degrees so that the convertible weight device case 10 resembles a triangular or pyramidal shape as shown in FIG. 3. More specifically, this A-frame rack configuration may be attained by first placing the second shell 18 on the floor surface, unlocking the clasps 20, and lifting the first shell 16 and rotating it about hinge 14 so that both the first shell 16 and the second shell 18 are on the floor surface. Then, the user can grasp the handle 12 and lift the convertible weight device case 10 by the handle 12 so that the hinge 14 and the handle 12 of the convertible weight device case 10 are elevated off the floor level and the first shell 16 and the second shell 18 are positioned in the angled upright configuration shown.

To maintain the convertible weight device case 10 in the A-frame rack configuration as shown in FIG. 3, a position locking mechanism may be provided. In particular, in the illustrated embodiment, a brace member 28 is installed onto the brace engagement mechanisms 24 and 26 of the first shell 16 and the second shell 18, respectively. The brace member 28 prevents the convertible weight device case 10 in the A-frame rack configuration from collapsing down to the floor surface. The brace member 28 in the illustrated embodiment is implemented as a rigid member that is sized at its ends to engage the engagement mechanisms 24 and 26. Of course, the brace member 28 may be implemented in any appropriate manner, for example, using a strap or cord. In addition, the position locking mechanism may be implemented in any appropriate manner in other embodiments. It should now be readily apparent that in the upright and open configuration in which the convertible weight device case 10 is in an A-frame rack configuration as shown in FIG. 3, the plurality of weight devices stored in the convertible weight device case 10 can be readily displayed and easily accessed for use.

Figure 4:
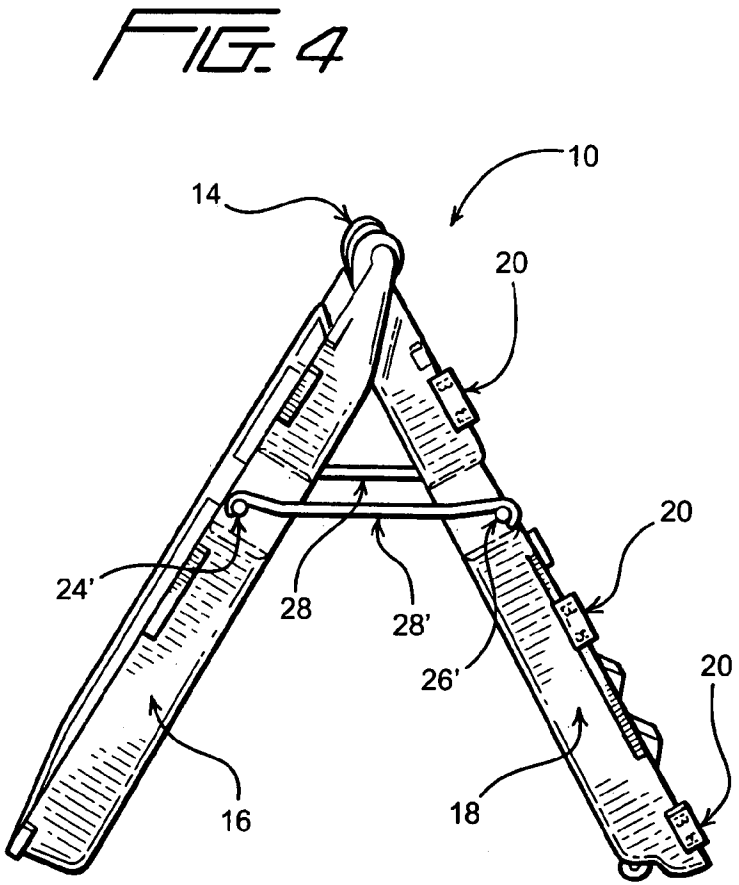
FIG. 4 is a side view of the convertible weight device case in the open rack configuration shown in FIG. 3.

FIG. 4 also shows a side profile view of the convertible weight device case 10 configured as an A-frame rack, showing the opposite side to that shown in FIG. 3. As shown, in the A-frame configuration, the first shell 16 and the second shell 18 have been rotated about hinge 14 more than 180 degrees relative to one another. In particular, in the illustrated embodiment of FIG. 4, the two shells of the convertible weight device case 10 have been rotated about hinge 14 approximately 300 degrees. In other words, in the rack configuration, the first shell 16 and the second shell 18 are angled upright at approximately 60 degrees relative to each other. Moreover, as most clearly shown in FIG. 4, a second brace member 28' may be installed on the brace engagement mechanisms 24' and 26' which are positioned on the side of the convertible weight device case 10 shown. The second brace member 28' is optional but would be desirable to enhance the rigidity of the convertible weight device case 10 when it is in the upright and open configuration as shown in FIGS. 3 and 4.

Figure 5:
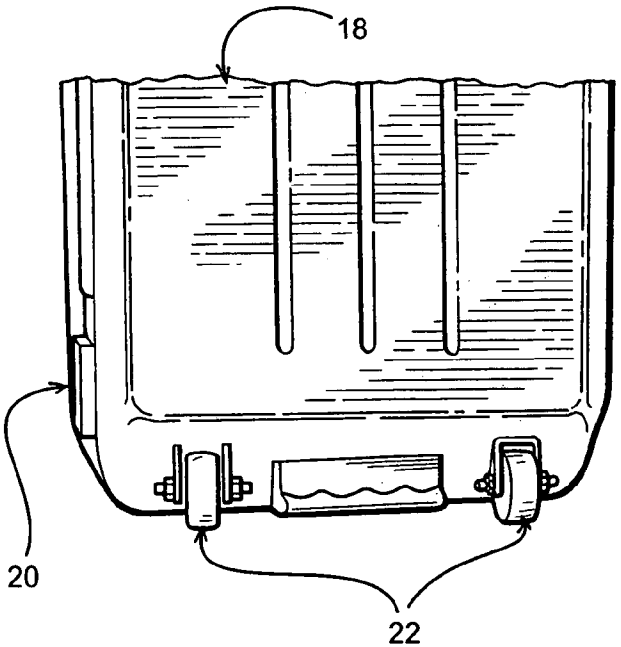
FIG. 5 is an enlarged view of wheels for the convertible weight device case in accordance with one embodiment of the present invention.

FIG. 5 shows an enlarged view of the wheels 22 of the convertible weight device case 10 in accordance with one embodiment of the present invention. As shown, the wheels 22 are rotatably mounted to the second shell 18 at an opposite end of the convertible weight device case 10 as the handle 12 so that when the convertible weight device case is lifted off a floor surface via the handle 12, the weight of the convertible weight device case 10 and the plurality of weight devices (not shown) stored therein are substantially supported by the wheels 22 so that they can be readily transported by the user without having to lift the convertible weight device case 10 with the weight devices stored therein.

Figure 6:
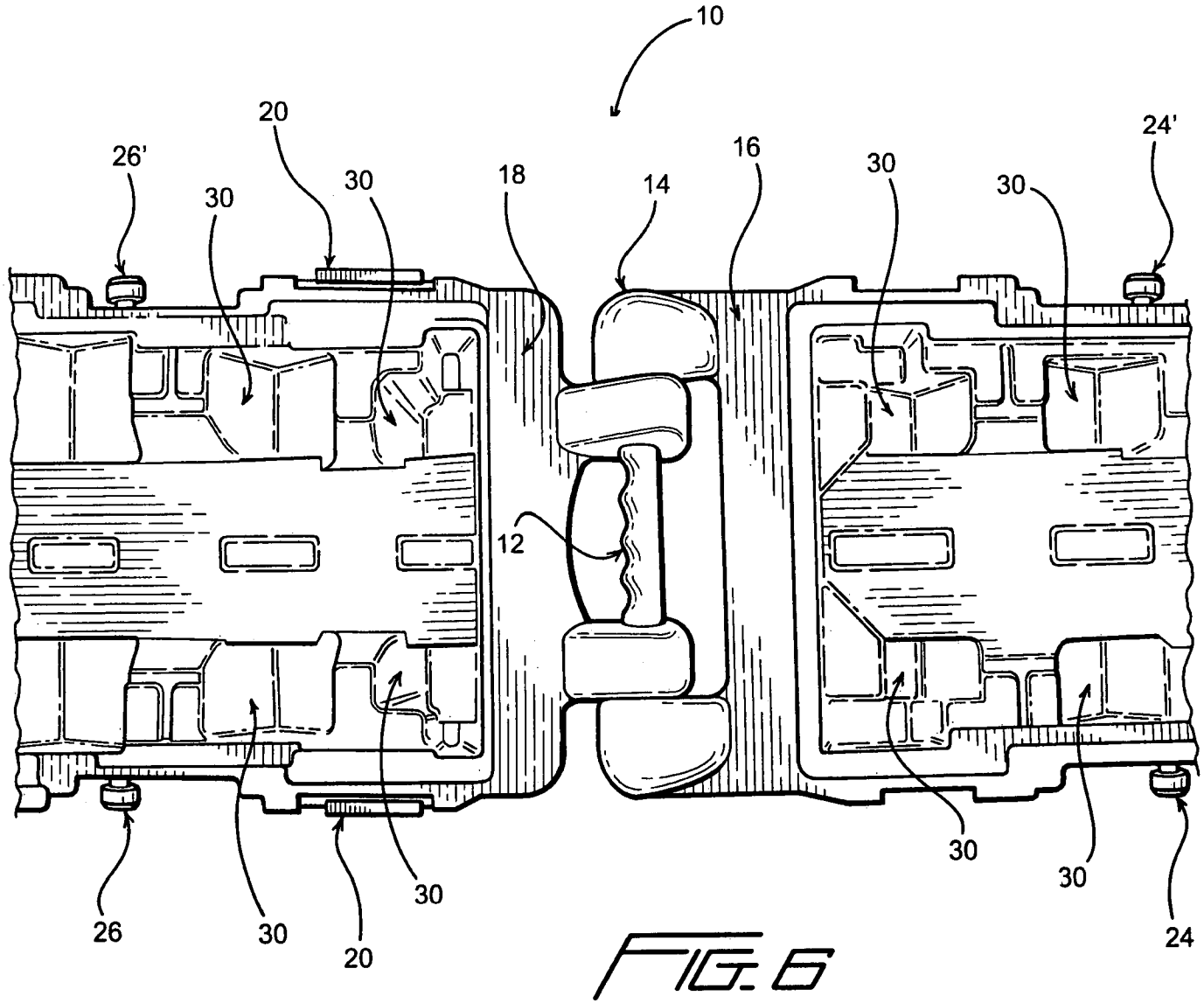
FIG. 6 is an enlarged view of the hinge, handle and compartments of the convertible weight device case shown in FIG. 1.

FIG. 6 shows a partial view of the convertible weight device case 10 of FIG. 1 which has been opened so that the first shell 16 and the second shell 18 are pivoted about hinge 14 and rest on the floor surface. Such positioning of the first shell 16 and the second shell 18 would allow the user to grasp the handle 12 and raise the handle 12 so that the convertible weight device case 10 is converted to an A-frame rack as shown in FIGS. 3 and 4 described above. As can be seen, the first shell 16 and the second shell 18 are provided with a plurality of compartments 30. In this regard, because the illustrated embodiment is implemented for storage of dumbbells, the plurality of compartments 30 are sized to receive dumbbells therein with a grip portion of the dumbbells extending width-wise across the shells 16 and 18.

Of course, in alternative implementations, the plurality of compartments may be correspondingly shaped to receive the weight device to be stored and displayed in the convertible weight device case of the present invention. In this regard, in an embodiment of the present invention which is implemented for storing and displaying weight plates, the compartments provided may be substantially circular to engage the periphery of the weight plates. Of course, to the extent that the weight plates have other geometrical shape, for example, an octagon, the compartments may be correspondingly shaped. Moreover, in such an application of the present invention, the compartments may further be provided with a central protrusion that engages the through hole provided on weight plates by which weight plates are mounted to the barbells. The central protrusion may further be provided with a fastening mechanism to more securely retain the weight plates in the compartments of the shells.

In the illustrated embodiment of FIG. 6 where the convertible weight device case 10 is adapted to store a plurality of dumbbells, the plurality of compartments 30 is provided along the length of the shells 16 and 18. The plurality of compartments 30 are preferably sized to hold various sizes of dumbbells with the smallest dumbbells being retained in compartments closest to the hinge 14 and the largest dumbbells being retained in compartments 30 that are positioned furthest away from the hinge 14 and closest to the wheels 22. Such a weight distribution would facilitate transporting of the convertible weight device case 10 with the dumbbells stored therein, and also facilitate setting up the convertible weight device case 10 in its upright and open configuration as shown in FIGS. 3 and 4 since it reduces the amount of weight that must be lifted to transport the convertible weight device case 10 with the dumbbells stored therein. Of course, location of smaller weight devices by the handle and larger weight devices by the wheels would also be advantageous where the weight devices are weight plates or other weight devices.

Figure 7:
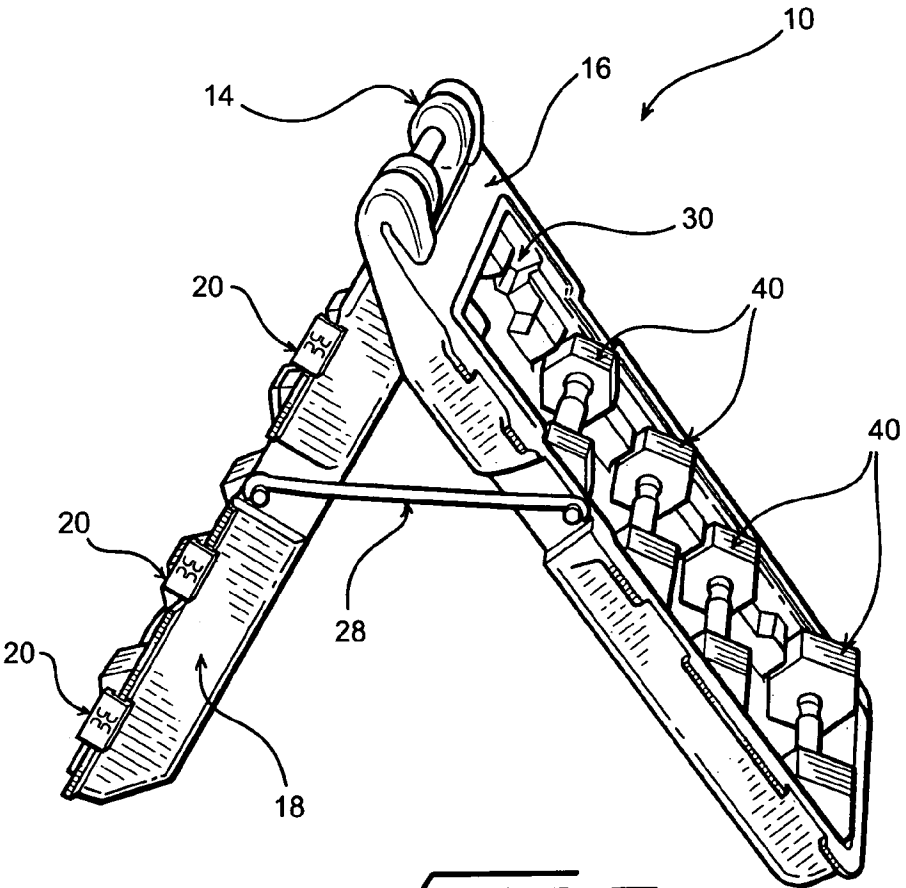
FIG. 7 is a side perspective view of the convertible weight device case in the open rack configuration with plurality of dumbbells received therein.
Figure 8:
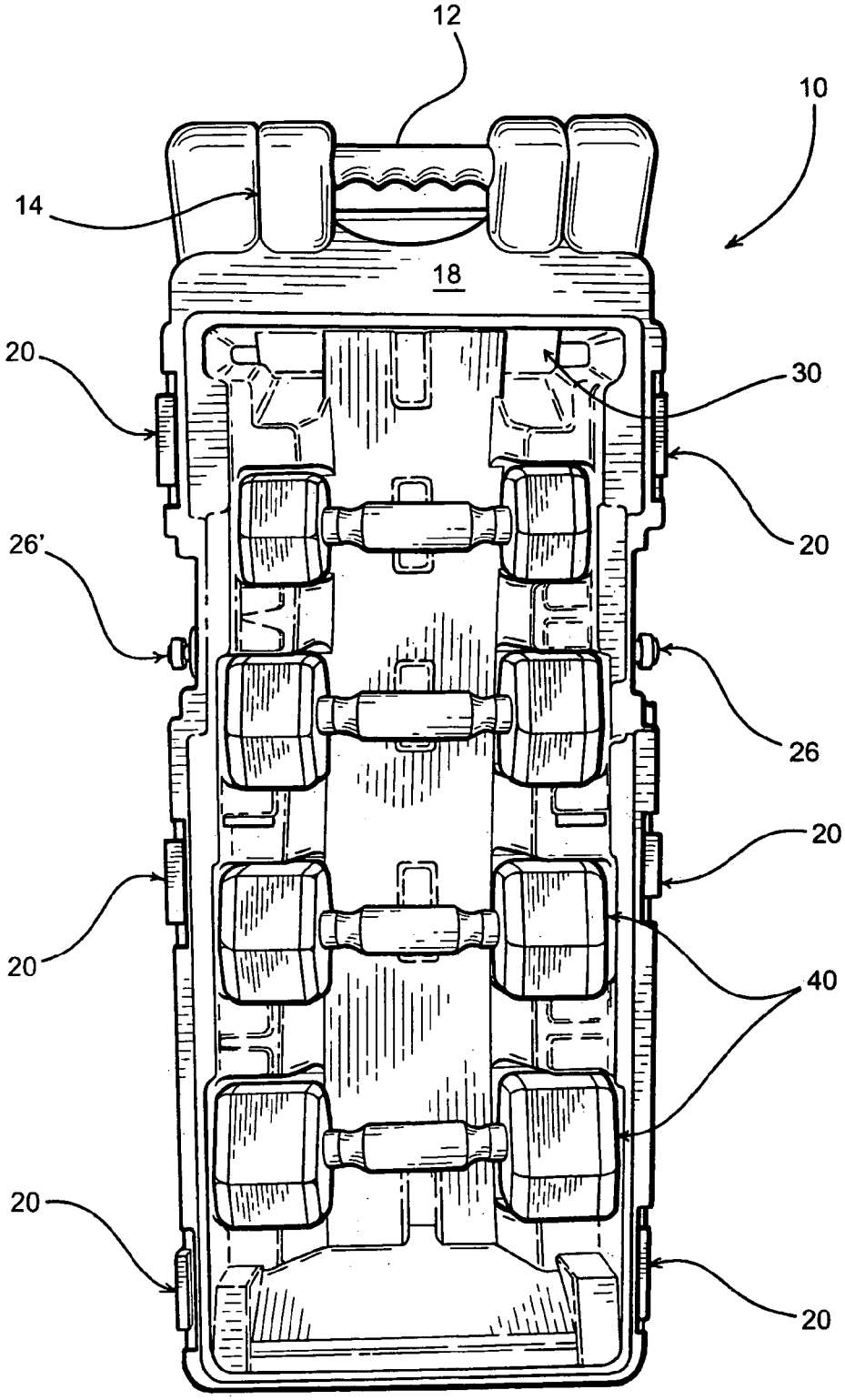
FIG. 8 is a frontal view of the convertible weight device case of FIG. 7 with the plurality of dumbbells received therein.

FIGS. 7 and 8 show the convertible weight device case 10 in accordance with one embodiment of the present invention in the A-frame rack configuration where a plurality of dumbbells are retained in the plurality of compartments 30 of the first shell 16 and the second shell 18 so as to illustrate how the present invention may be used. As shown, the convertible weight device case 10 is triangular or pyramidal in this A-frame rack configuration, the brace member 28 maintaining the convertible weight device case 10 in this configuration (the brace member 28' not shown). In the rack configuration, access to the plurality of compartments 30 is provided by the convertible weight device case 10 due to their outward positioning so as to allow the user to access the dumbbells 40 stored in the compartments 30 of the first shell 16 and the second shell 18.

As can be seen in FIG. 8, the plurality of compartments 30 are sized in the present embodiment so that the smallest compartment for receiving the lightest dumbbells are positioned closest to the hinge 14 while the largest compartments for receiving the largest dumbbells are positioned furthest away from the hinge 14 as previously noted. It should also be noted that with respect to FIGS. 7 and 8, one of the smallest dumbbells has been removed from its compartment to better illustrate the compartments 30. However, in use, a small dumbbell may be received and retained therein. Of course, in other embodiments, the compartments of the convertible weight device case 10 may be sized for dumbbells having the same size, or may be arranged in a different manner than that as described. Moreover, whereas the convertible weight device case 10 is adapted to retain five pairs of dumbbells, other embodiments of the present invention may be adapted to retain different number of dumbbells.

It can also be appreciated in view of FIGS. 7 and 8 that once the convertible weight device case 10 is transported to a desired location and placed in the A-frame rack configuration as shown, the user has ready access to the plurality of dumbbells 40. If the user desires to transport or store the dumbbells, the convertible weight device case 10 can be converted back to the closed configuration shown in FIGS. 1 and 2 by reversing the method described and moved to the desired location. Thus, the convertible weight device case 10 can be readily used for protecting, storing and/or transporting weight devices such as dumbbells shown.

Moreover, when the convertible weight device case 10 of the present embodiment is converted to an A-frame rack, equivalently sized dumbbells are positioned at substantially the same height off the floor surface. In other words, one dumbbell of a dumbbell pair is received in a compartment of the first shell 16 while the other dumbbell is received in a compartment of the second shell 18. The corresponding pairs of compartments are positioned in the first and second shells 16 and 18 so that dumbbells having the same weight are paired in terms of the height distance from the floor surface. This allows the user to readily grasp the matching pair of dumbbells from the convertible weight device case 10 for use in exercising or the like. In the illustrated embodiment, the corresponding pairs of compartments are also slightly staggered between the first shell 16 and the second shell 18 to reduce the thickness of the convertible weight device case 10. In other words, the compartments provided in the second shell 18 are offset with respect to the compartments in the first shell 18 when the convertible weight device case 10 is in the closed configuration. Of course, such features are optional and need not be provided in other embodiments.

The convertible weight device case of the present invention may be manufactured from any appropriate materials that can readily support the weight devices that are stored therein. In this regard, the convertible weight device case may advantageously be made of variety of injection molded plastics or other readily moldable materials. Such moldability would be desirable in that the plurality of compartments can be integrally molded with the first and second shells. In this regard, the compartments can then be intricately formed so as to provide retaining mechanisms such as extending protrusions that retain the weight devices stored in the compartments such as dumbbells and/or weight plates, or other weight devices so that they do not fall out of the compartments as the convertible weight device case 10 is converted to the rack configuration described.

Of course, various features of the convertible weight device case 10 shown and described above may be made of different materials. For instance, the brace members 28 and 28' as well as the handle 12, and/or various components of the hinge 14 and wheels 22 may be made of metal to ensure durability and sufficient strength. Moreover, whereas in the present embodiment, the clasps 20 and the brace engagement mechanisms may be made of a plastic material secured to the first and/or second shells 16 and 18, these components may also be implemented in a different manner, for example, using metallic components such as buckles or the like. Of course, any appropriate material may be used for the various components.

Furthermore, it should also be appreciated that the size and shape as well as the positioning of various features of the convertible weight device case 10 may be altered or otherwise changed in other embodiments of the present invention. For instance, the handle 12 for transporting the convertible weight device case 10 may be positioned elsewhere than by the hinge 14 as shown. Moreover, different types of clasps may be used and the wheels 22 may be positioned elsewhere. In this regard, in another embodiment of the present invention, the wheels need not be provided at all. However, it should be evident that the preferred embodiment of the convertible weight device case would be provided with such wheels for facilitating the transport thereof.

Moreover, other position locking mechanisms may be used to maintain the convertible weight device case of the present invention in the upright and open configuration instead of using rigid braces as shown in FIGS. 3 and 4. In this regard, any type of securing or locking mechanism may be used. For example, the hinge 14 may be provided with a lock pin which locks the hinge's position so that unintentional movement between the shells is prevented. In still another example, a detent and a pawl mechanism may be provided on the hinge 14 to allow fixing of the positions of the first shell 16 and the second shell 18 in the upright and open configuration of the dumbbell carrying case 10. Of course, it should be noted that the above described position locking mechanisms for maintaining the A-frame rack configuration of the convertible weight device case 10 are merely examples and other implementations may be used.

In addition, it should also be noted that in other embodiments of the present invention, the hinge that hingeably connects the two shells of the convertible weight device case as described above need not be provided. In such an embodiment, the two shells may be manually put into the A-frame rack configuration by lifting one end of each shell so that the shells are upright with the compartments positioned facing outward, and securing the lifted ends together at one edge of the shells so that the shells form a triangular or pyramidal A-frame rack. Of course, any appropriate securing mechanism for securing the lifted ends of the shells may be provided in such embodiments. For example, interlocking features such as clips, brackets, receiving openings, engagement mechanisms or the like may be directly molded or otherwise attached to the shells. Once such convertible weight device case is configured into an A-frame rack, it provides the user with easy access to the weight devices stored therein.

Figure 10:
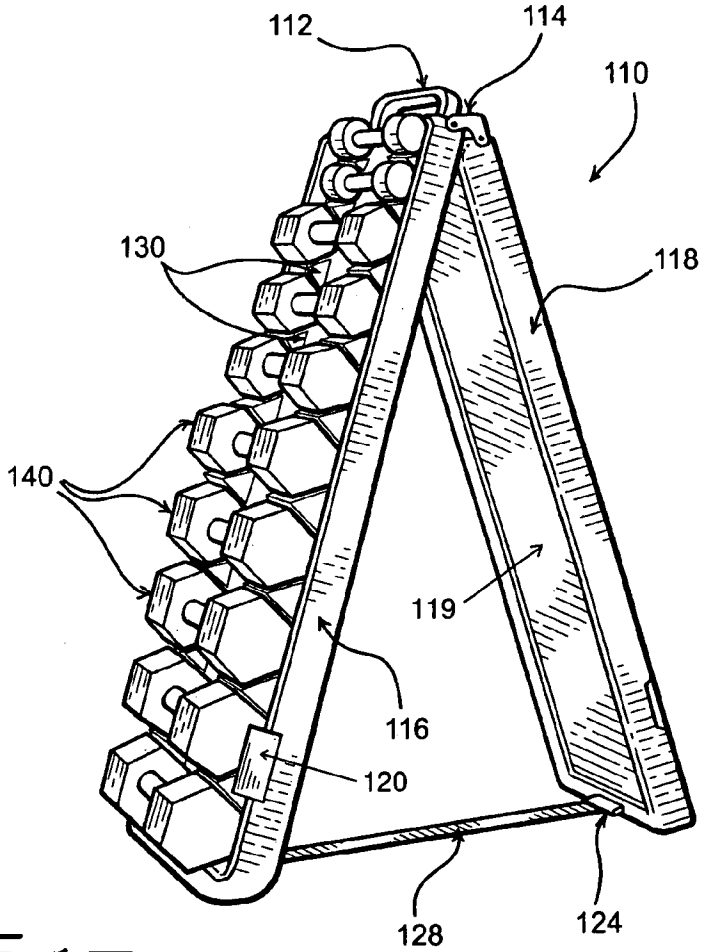
FIG. 10 is a side perspective view of the convertible weight device case of FIG. 9 in its open rack configuration.
Figure 9:
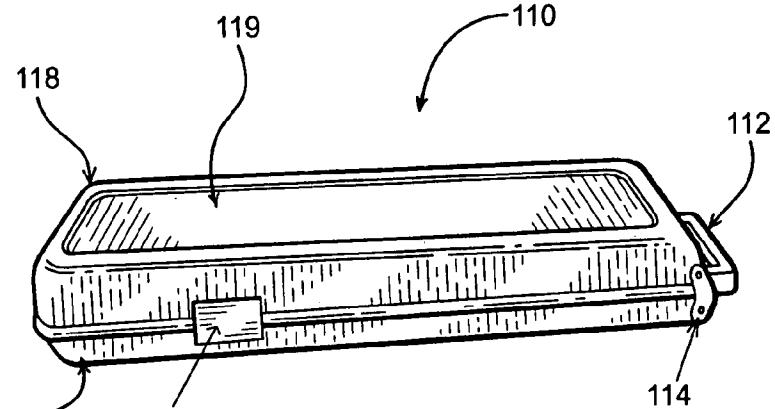
FIG. 9 is a side perspective view of a convertible weight device case in accordance with another embodiment of the present invention, the convertible weight device case in its closed configuration.

FIGS. 9 and 10 show side perspective views of a convertible weight device case 110 in accordance with another embodiment of the present invention, the convertible weight device case 110 being shown in its closed configuration in FIG. 9, and in its upright and open configuration in FIG. 10. The convertible weight device case 110 is adapted to store and display a plurality of dumbbells, the general operation and function of the convertible weight device case 110 being substantially similar to the embodiment of FIGS. 1 to 8 described in detail above. However, various aspects of the convertible weight device case 110 differs from the embodiments previously described, such aspects being described in further detail below.

As shown in FIG. 9, the convertible weight device case 110 has an elongated shape with compartments (not shown) sized to allow storage and transport of a plurality of dumbbells therein. The convertible weight device case 110 preferably includes a handle 112 that may be grasped by the user to transport the convertible weight device case 110. In addition, the convertible weight device case 110 is provided with hinges 114 (only one shown) which is provided at the two sides of the convertible weight device case 110. The hinges 114 allows the convertible weight device case 110 to be opened and configured as an A-frame rack in the manner described above.

In the above regard, the convertible weight device case 110 comprises two shells, a first shell 116 and a second shell 118 that are sized substantially similarly so that they can be interfaced together in a clam shell manner in the closed configuration of FIG. 9. The hinges 114 are secured to the ends of the first shell 116 and the second shell 118 to allow the shells to be rotated relative to each other so as to allow closing and opening of the convertible weight device case 110. In addition, a plurality of clasps 120 (only one shown) is provided to secure the first shell 116 and the second shell 118 together when the convertible weight device case 110 is in the closed configuration. As also shown, the outer surface of the shell 118 is provided with a label area 119 to which a label with pictures of and/or information associated with, the weight devices stored with the convertible weight device case 110 may be affixed. Of course, provision of a label is optional and need not be provided.

FIG. 10 shows a side perspective view of the convertible weight device case 110 in its upright and open configuration in which the convertible weight device case 110 is converted to an A-frame rack. As shown, the first shell 116 and the second shell 118 are pivoted about the hinges 114 beyond 180 degrees so that the convertible weight device case 110 resembles a triangular or pyramidal shape as shown in FIG. 10. In the illustrated embodiment, the first shell 116 and the second shell 118 are rotated about the hinges 114 approximately 300 degrees to be placed into the A-frame rack configuration shown.

In contrast to the prior embodiment, the handle 112 is not integrated with the hinges 114, but is separately mounted to the first shell 116. Furthermore, the convertible weight device case 110 is provided with a position locking mechanism which is implemented as a brace member 128 which engages a brace engagement mechanisms 124 implemented as a slot (only one shown) on the first shell 116 and second shell 118. This position locking mechanism maintains the convertible weight device case 110 in the upright and open configuration so as to prevent the convertible weight device case 110 from collapsing down to the floor surface when in the A-frame rack configuration. More specifically, in the illustrated embodiment, the brace member 128 is implemented as a strap with hooks that engage the brace engagement mechanism 124. However, the brace member may be implemented as a rigid member in other embodiments. In addition, the brace member 128 may be provided with hooks, buckles or the like to allow securement to the brace engagement mechanisms provided on the shells. Of course, as also previously noted, the position locking mechanism may be implemented in any appropriate manner in other embodiments, for example, using a lock pin or a detent/pawl mechanism.

As previously noted, the convertible weight device case 110 of the illustrated embodiment is adapted to carry a plurality of dumbbells therein. Hence, a plurality of compartments 130 are provided along the length of the first shell 116. The plurality of compartments 130 are preferably sized to hold various sizes of dumbbells 140 as shown in FIG. 10. In the illustrated embodiment, the smallest dumbbells are retained in compartments closest to the hinge 114 while the largest dumbbells being retained in compartments 130 that are positioned furthest away from the hinge 114.

In contrast to the prior embodiment of FIGS. 1 to 8, the convertible weight device case 110 in accordance with the embodiment of FIGS. 9 and 10 retains a plurality of dumbbells 140 only in the first shell 116. In this regard the plurality of compartments 130 are only provided in the first shell 116, and not in the second shell 118. Thus, the second shell 118 in the present embodiment acts as a brace that allows the convertible weight device case 1110 to be configured into the triangular or pyramidal A-frame rack, but does not store dumbbells therein. Of course, the second shell 118 also acts as a cover to enclose the dumbbells 140 stored in the first shell 116 when the convertible weight device case 110 is in its closed configuration as shown in FIG. 9 so as to retain the dumbbells 140 in the convertible weight device case 110 when in the closed configuration. However, because the second shell 118 is not provided with any compartments for receiving weight devices therein, the second shell 118 need not be substantially the same size as the first shell 116 or fully enclose the compartments 130. Instead, in other embodiments, the second shell may be implemented as members that impede access to the weight devices in the compartments 130 of the first shell 116, but does not enclose the compartments.

Because dumbbells are typically used in pairs, the first shell 116 of the illustrated embodiment is provided with matched pairs of compartments 130 which are sized to retain a pair of the same weight dumbbells. Thus, as shown in FIG. 10, the convertible weight device case 110 stores five pairs of matched dumbbells, the lightest pair being stored near the hinges 114 and handle 112. In the A-frame rack configuration shown in FIG. 10, the plurality of dumbbells 140 that are stored in the convertible weight device case 110 can be readily displayed and easily accessed for use.

Of course, it should be appreciated that in other embodiments, the convertible weight device case 110 may be provided with various other features as well. For example, wheels for facilitating the transport of the convertible weight device case 110 may be provided. In addition, the hinge may be provided integrally with the handle. Furthermore, any type of securing or locking mechanism may be used to maintain the convertible weight device case 110 in the A-frame rack configuration instead of via the brace member 128 shown. Furthermore, whereas the convertible weight device case 110 shown is specifically applicable to dumbbells 140, the present invention is not limited thereto. The convertible weight device case of the present invention is readily applicable to other weight devices such as weight plates as previously noted, and the present invention encompasses convertible weight device cases implemented for such weight devices.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications. Consequently, the present invention should be broadly understood to encompass convertible weight device case which is adapted to be configured from a closed configuration, to an A-frame rack configuration that allows access to the plurality of weight devices stored therein.

The invention claimed is:

1. A convertible weight device case comprising:

a first shell having a plurality of compartments with a plurality of dumbbells located therein;

a second shell;

at least one hinge pivotably connecting said first shell to said second shell to allow said first shell and said second shell to be rotated about said hinge relative to each other between a closed configuration and a rack configuration; and a handle that is integrated with said at least one hinge;

wherein in said closed configuration, said first shell and said second shell are interfaced together so that said second shell impedes access to the dumbbells received in said plurality of compartments of said first shell; and wherein in said rack configuration, said first shell and said second shell are angled upright with said at least one hinge elevated above a floor level so that access to said plurality of compartments of said first shell and easy removal of the dumbbells from the compartments is provided.

2. The convertible weight device case of claim 1, wherein one of said first shell and said second shell is rotated more than 180 degrees about said hinge relative to other of said first shell and said second shell.

3. The convertible weight device case of claim 2, wherein one of said first shell and said second shell is rotated approximately 300 degrees about said hinge relative to other of said first shell and said second shell.

4. The convertible weight device case of claim 1, wherein in said rack configuration, said first shell and said second shell are angled upright at approximately 60 degrees relative to each other.

5. The convertible weight device case of claim 1, wherein said convertible weight device case further includes a position locking mechanism for maintaining said convertible weight device case in said rack configuration.

6. The convertible weight device case of claim 5, wherein said position locking mechanism is a rigid brace.

7. The convertible weight device case of claim 5, wherein said position locking mechanism is at least one of a strap and a cord.

8. The convertible weight device case of claim 5, wherein at least one of said first shell and said second shell includes a brace engagement mechanism adapted to engage said position locking mechanism.

9. The convertible weight device case of claim 1, further comprising a plurality of clasps for securing said first shell and said second shell together when said convertible case is in said closed configuration.

10. The convertible weight device case of claim 1, wherein said plurality of compartments in said first shell are a plurality of different sizes.

11. The convertible weight device case of claim 10, wherein a smallest of said plurality of compartments is positioned proximate to said at least one hinge.

12. The convertible weight device case of claim 11, wherein the sizes of said compartments increases away from said at least one hinge.

13. The convertible weight device case of claim 1, wherein said first shell has a first longitudinal end with a pair of first hinge members extending longitudinally from said first longitudinal end, wherein said second shell has a second longitudinal end with a pair of second hinge members extending longitudinally from said second longitudinal end, whereby said first and second hinge members form said at least one hinge, and wherein said handle is positioned between paired ones of said first and second hinge members.

14. The convertible weight device case of claim 1, wherein said second shell of said convertible weight device case further includes a plurality of compartments with a plurality of dumbbells located therein.

15. The convertible weight device case of claim 14, wherein said convertible weight device case is adapted to store plurality of pairs of dumbbells, one dumbbell of each pair being received in a compartment of said first shell, and the other dumbbell of each pair being received in a compartment of said second shell that corresponds to said compartment of said first shell.

16. The convertible weight device case of claim 15, wherein said plurality of compartments of said second shell are positioned so that when said convertible weight device case is in said rack configuration, one dumbbell of each of said plurality of pairs of dumbbells that is received in a compartment of said first shell is elevated substantially similar distance above a floor surface as the other dumbbell of each of said plurality of pairs of dumbbells that is received in a corresponding compartment of said second shell.

17. The convertible weight device case of claim 15, wherein said plurality of compartments of said second shell are positioned offset to said plurality of compartments of said first shell.

18. The convertible weight device case of claim 1, wherein said convertible weight device case further includes at least two wheels to allow said convertible weight device case to be rolled.

19. The convertible weight device case of claim 18, wherein said at least two wheels are positioned at an opposite end of said convertible weight device case from said handle.

20. A convertible weight device case that is convertible between a closed configuration and a rack configuration comprising:

a first shell having a plurality of compartments with a plurality of dumbbells located therein;

a second shell;

at least one hinge pivotably connecting said first shell to said second shell to allow said first shell and said second shell to be rotated more than 180 degrees about said hinge relative to each other;

a handle that is integrated with said at least one hinge;

at least one clasp for securing said first shell and said second shell together when said convertible case is in said closed configuration wherein said first shell and said second shell are interfaced together so that said second shell impedes access to the dumbbells received in said plurality of compartments of said first shell; and a position locking mechanism for maintaining said convertible weight device case in said rack configuration wherein said first shell and said second shell are angled upright with said at least one hinge and handle elevated and handle above a floor level so that access to said plurality of compartments of said first shell and easy removal of the dumbbells from the compartments is provided.

21. The convertible weight device case of claim 20, wherein said first shell has a first longitudinal end with a pair of first hinge members extending longitudinally from said first longitudinal end, wherein said second shell has a second longitudinal end with a pair of second hinge members extending longitudinally from said second longitudinal end, whereby said first and second hinge members form said at least one hinge, and wherein said handle is positioned between paired ones of said first and second hinge members.

22. The convertible weight device case of claim 20, wherein said second shell of said convertible weight device case further includes a plurality of compartments with a plurality of dumbbells located therein.

23. The convertible weight device case of claim 22, wherein said convertible weight device case is adapted to store a plurality of pairs of dumbbells, one dumbbell of each pair being received in a compartment of said first shell, and the other dumbbell of each pair being received in a compartment of said second shell that corresponds to said compartment of said first shell.

24. The convertible weight device case of claim 23, wherein said plurality of compartments of said second shell are positioned so that when said convertible weight device case is in said rack configuration, one dumbbell of each pair of dumbbells that is received in a compartment of said first shell is elevated a substantially similar distance above a floor surface as the other dumbbell of each pair of dumbbells that is received in a corresponding compartment of said second shell.

25. The convertible weight device case of claim 20, wherein said convertible weight device case further includes at least two wheels to allow said convertible weight device case to be rolled.

26. A method of displaying a plurality of weight devices stored in a convertible weight device case comprising the steps of:

providing a convertible weight device case including:

a first shell having a plurality of compartments with a plurality of dumbbells located therein;

a second shell;

at least one hinge pivotably connecting said first shell to said second shell; and a handle that is integrated with said at least one hinge;

rotating at least one of said first shell and said second shell more than 180 about said hinge relative to the other; and angling upright said first shell and said second shell with said handle so that said at least one hinge is elevated above a floor level and such that access to said plurality of compartments of said first shell and easy removal of the dumbbells from the compartments is provided.

27. The method of claim 26, further including the step of locking said convertible weight device case in said rack configuration.

28. The method of claim 27, wherein said step of locking is attained using a position locking mechanism.

29. The method of claim 26, wherein said convertible weight device case further includes a plurality of clasps to secure said first shell and said second shell together when said convertible case is in a closed configuration.

30. The method of claim 26, wherein said first shell has a first longitudinal end with a pair of first hinge members extending longitudinally from said first longitudinal end, wherein said second shell has a second longitudinal end with a pair of second hinge members extending longitudinally from said second longitudinal end, whereby said first and second hinge members form said at least one hinge, and wherein said handle is positioned between paired ones of said first and second hinge members.

31. The method of claim 26, wherein said second shell of said convertible weight device case further includes a plurality of compartments with a plurality of dumbbells located therein.

32. The method of claim 26, wherein said convertible weight device case further includes at least two wheels to allow said convertible weight device case to be rolled.

33. A convertible weight device case that is convertible between a closed configuration and a rack configuration comprising:

a first shell having a plurality of compartments with a plurality of dumbbells located therein;

a second shell;

a hinge axis about which said first shell is pivotally connected to said second shell to allow said first shell and said second shell to be rotated about said hinge axis relative to each other between the closed configuration and the rack configuration;

an elongate handle located along said hinge axis;

at least one clasp for securing said first shell and said second shell together when said convertible case is in said closed configuration wherein said first shell and said second shell are interfaced together so that said second shell impedes access to the dumbbells received in said plurality of compartments of said first shell; and a position locking mechanism for maintaining said convertible weight device case in said rack configuration wherein said first shell and said second shell are angled upright so that access to said plurality of compartments of said first shell and easy removal of the dumbbells from the compartments is provided.

34. The convertible weight device case of claim 33, wherein said second shell of said convertible weight device case further includes a plurality of compartments with a plurality of dumbbells located therein.

35. The convertible weight device case of claim 33, wherein said first shell has a first longitudinal end with a pair of first hinge members extending longitudinally from said first longitudinal end, wherein said second shell has a second longitudinal end with a pair of second hinge members extending longitudinally from said second longitudinal end, whereby said first and second hinge members form said at least one hinge, and wherein said handle is positioned between paired ones of said first and second hinge members.

36. The convertible weight device case of claim 33, wherein said convertible weight device case further includes at least two wheels to allow said convertible weight device case to be rolled.

* * * * *